US008109797B2

(12) United States Patent
Su et al.

(10) Patent No.: US 8,109,797 B2
(45) Date of Patent: Feb. 7, 2012

(54) CABLE CONNECTOR ASSEMBLY AND METHOD OF MANUFACTURING THE SAME

(75) Inventors: Ping-Sheng Su, Tu-Cheng (TW); Li-Song Cao, Kunshan (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 14 days.

(21) Appl. No.: 12/824,247

(22) Filed: Jun. 28, 2010

(65) Prior Publication Data

US 2010/0330839 A1 Dec. 30, 2010

(30) Foreign Application Priority Data

Jun. 26, 2009 (CN) ..... 2009 2 0305141

(51) Int. Cl.
*H01R 13/502* (2006.01)

(52) U.S. Cl. ..... 439/701; 439/471

(58) Field of Classification Search ..... 439/470–471, 439/607.02, 271, 402, 701, 462, 353
See application file for complete search history.

(56) References Cited

U.S. PATENT DOCUMENTS

| | | | | |
|---|---|---|---|---|
| 5,368,505 | A * | 11/1994 | Hoolhorst et al. | 439/701 |
| 5,755,597 | A * | 5/1998 | Panis et al. | 439/607.47 |
| 6,217,364 | B1 * | 4/2001 | Miskin et al. | 439/358 |
| 6,231,392 | B1 * | 5/2001 | van Woensel | 439/607.44 |
| 6,935,886 | B2 * | 8/2005 | Hoch et al. | 439/462 |

FOREIGN PATENT DOCUMENTS

| | | |
|---|---|---|
| TW | M300908 | 11/2006 |

* cited by examiner

*Primary Examiner* — Jean F Duverne
(74) *Attorney, Agent, or Firm* — Wei Te Chung; Andrew C. Cheng; Ming Chieh Chang

(57) ABSTRACT

A cable connector assembly, for mating with a complementary connector, includes a cable having a number of wires; and a connector comprising a contact module connected with the wires, a mounting ring attached to the cable, and a shielding shell attached to the mounting ring. The shielding shell and the mounting ring both have a number of screw threads to match with each other. An associated method of manufacturing the cable connector assembly comprises screwing the shielding shell onto the mounting ring.

2 Claims, 3 Drawing Sheets

CABLE CONNECTOR ASSEMBLY AND METHOD OF MANUFACTURING THE SAME

BACKGROUND OF THE INVENTION

1. Field of the Invention

The present invention relates to a cable connector assembly, and more particularly to a cable connector assembly having a mounting ring.

2. Description of Related Art

TW Patent Application Issue No. M300908 issued on Dec. 11, 2006 discloses a cable connector assembly comprising an electrical connector and a cable connected with the electrical connector. The electrical connector comprises a contact module connected with the cable, an upper inner shell half and a lower inner shell half cooperating with each other to form a receiving cavity therebetween for partially receiving the contact module, and an upper outer shell half and a lower outer shell half cooperating with each other to form a receiving room therebetween for enclosing the contact module, the upper inner shell half, and the lower inner shell half The cable comprises a mounting portion with a slot surrounding the cable. The mounting portion is over-molded on the cable. The upper outer shell half and the lower outer shell half are fixed to the cable with their rear ends partially received in the slot.

Such a cable connector assembly has a complicated configuration. Furthermore, it is inconvenient to assemble the cable connector assembly.

Hence, a cable connector assembly which can be easily assembled is highly desired.

SUMMARY OF THE INVENTION

Accordingly, an object of the present invention is to provide a cable connector assembly which can be easily assembled and a method for manufacturing the cable connector assembly.

In order to achieve the object set forth, a cable connector assembly comprises a connector and a cable with a number of wires connected with the connector. The connector comprises a contact module connected with the wires, a mounting ring attached to the cable, and a shielding shell attached to the mounting ring. The shielding shell and the mounting ring both have a number of screw threads to match with each other.

A method for manufacturing a cable connector assembly, comprising the steps of: connecting a contact module with wires of a cable; attaching a mounting ring having a plurality of external screw threads to the cable; screwing a shielding shell having a plurality of internal screw threads to the mounting ring; mounting a front shell to the shielding shell along a front-to-back direction.

The configuration of the cable connector assembly is simple. It is convenient to assemble such a cable connector assembly.

Other objects, advantages and novel features of the invention will become more apparent from the following detailed description when taken in conjunction with the accompanying drawings.

DETAILED DESCRIPTION OF THE PREFERRED EMBODIMENT

Figure 1:
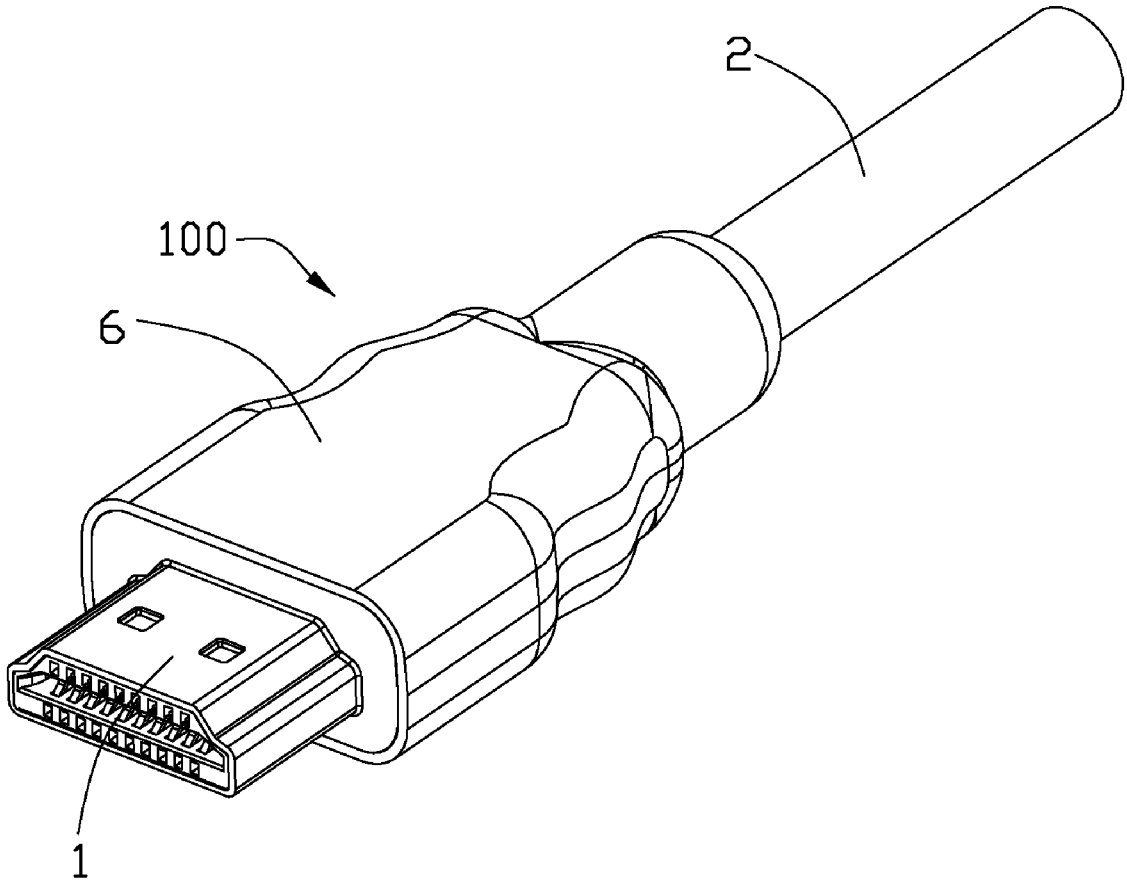
FIG. 1 is an assembled perspective view showing a cable connector assembly in accordance with the present invention.
Figure 2:
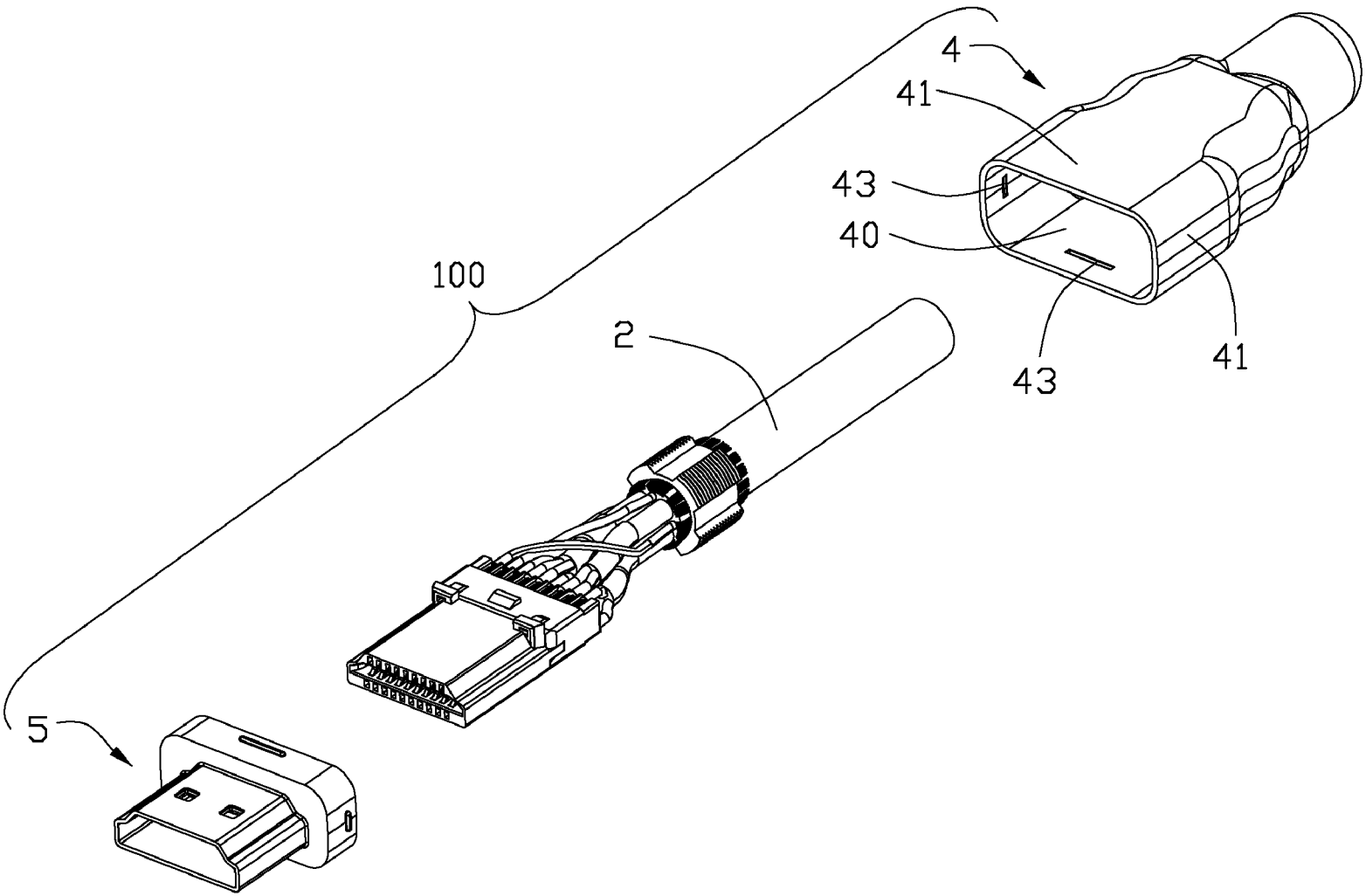
FIG. 2 is an exploded, perspective view of the cable connector assembly.
Figure 3:
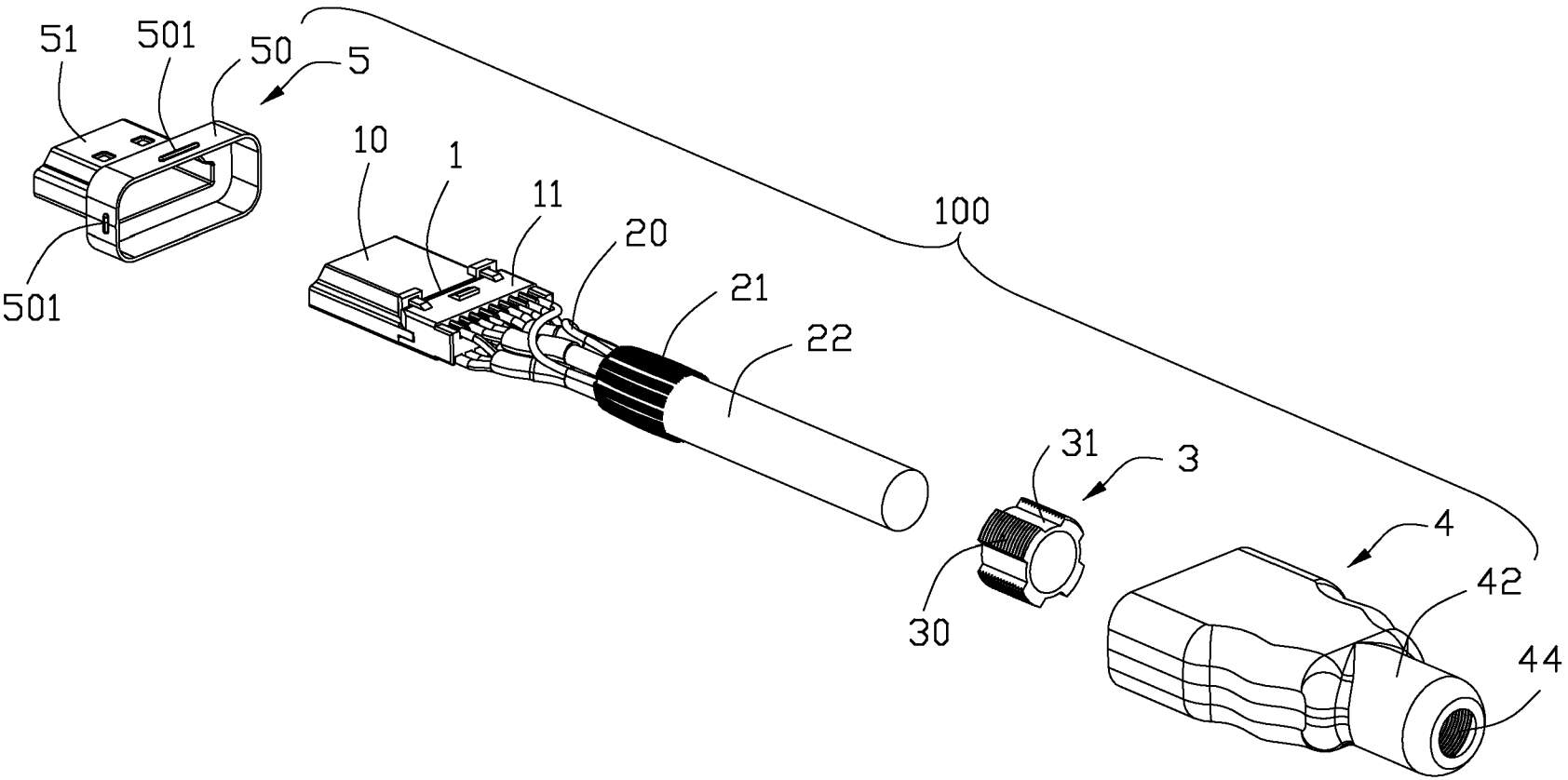
FIG. 3 is similar to FIG. 2, viewed from another aspect.

Reference will now be made in detail to the preferred embodiment of the present invention. Referring to FIGS. 1-3, a cable connector assembly 100 for mating with a complementary connector (not shown) comprises a connector 6 and a cable 2 having a plurality of wires 20. Each wire 20 has a front end (not labeled) connected with the connector 6.

The connector 6 comprises a contact module 1 connected with the front ends of the wires 20, a mounting ring 3 attached to the cable 2, a shielding shell 4 attached to the mounting ring 3, and a front shell 5 attached to the shielding shell 4 along a front-to-back direction. The shielding shell 4 and the mounting ring 3 both have a plurality of screw threads to match with each other. The mounting ring 3 is received in the shielding shell 4.

The contact module 1 comprises a mating portion 10 for mating with the complementary connector, and a connecting portion 11 connected with the wires 20. The contact module 1 is attached to the front shell 5. The mating portion 10 is received in the front shell 5.

The cable 2 comprises a braided layer 21 surrounding the wires 20, and an insulative layer 22 coating on the braided layer 21.

The mounting ring 3 comprises a plurality of screwed portions 30, and a plurality of riveting portions 31 riveted on the cable. The screwed portions 30 have a plurality of screw threads formed on an outer surface thereof for matching with the shielding shell 4. Each riveting portion 31 is disposed between adjacent two screwed portions 30. The screwed portions 30 and the riveting portions 31 are spaced one by one along a circling direction around the cable 2.

A part of the braided layer 21 is exposed outside of the insulative layer 22 and the mounting ring 3 is riveted on said part of the braided layer 21. The mounting ring 3 is electrically connected between the shielding shell 4 and the braided layer 21. To install the mounting ring 3, a part of the braided layer 21 is firstly exposed outside of the insulative layer 22. Then, make said part of the braided layer 21 bent rearwards to surround the insulative layer 22. Thirdly, install the mounting ring 3 on said part of the braided layer 21 which is bent rearwards to surround the insulative layer 22. Fourthly, rivet the riveting portions 31 to make the mounting ring 3 attached to the cable 2. In another option, the mounting ring 3 could be directly riveted on the insulative layer 22.

The shielding shell 4 comprises a receiving room 40 recessed from a front end of the shielding shell 4 for partially receiving the cable 2, a plurality of side walls 41 surrounding the receiving room 40, and a thread-portion 42 located at a rear end of the receiving room 40 and having a plurality of screw threads formed on an inner surface thereof for matching with the mounting ring 3. The thread-portion 42 has a stop-hole 44 defined at a rear end thereof behind the screwed portions 30. The stop-hole 44 has a diameter smaller than a diameter of the mounting ring 3 and greater than a diameter of the cable 2.

Referring to FIGS. 1-3, the front shell 5 is attached to the shielding shell 4 along a front-to-back direction. The front shell 5 cooperates with the shielding shell 4 to form a receiving cavity therebetween for receiving the contact module 1. The wires 20 are curly or slack within the shielding shell 4. The front shell 5 comprises a front portion 51 receiving the mating portion 10 and a rear portion 50 attached to the shielding shell 4. The rear portion 50 comprises a plurality of outer protrusions 501. The shielding shell 4 comprises a plurality of slots 43 receiving the outer protrusions 501, respectively. The front shell 5, the shielding shell 4 and the mounting ring 3 are made of conductive material, so that the contact module 1 does not need another shielding structure for suppressing electromagnetic interference. The wires 20 are long enough to ensure that the front shell 5 and the contact module 1 do not interfere the screwing movement of the shielding shell 4. When the connector assembly 100 is assembled well, the wires 20 are shrunk to be curly and secured in the shielding shell 4.

To manufacture the cable connector assembly 100, firstly, provide the cable 2 with a plurality of wires 20. Secondly, provide the shielding shell 4 with the receiving room 40 and make the cable 2 pass into the shielding shell 4 through the receiving room 40, the shielding shell 4 has a plurality of screw threads. Thirdly, provide the mounting ring 3 having a plurality of screw threads for matching with the shielding shell 4 and mount the mounting ring 3 to the cable 2. Fourthly, provide the contact module 1 for mating with the complementary connector, and connect the contact module 1 with the front ends of the wires 20. Fifthly, provide the front shell 5, and attach the contact module 1 to the front shell 5. Sixthly, screw the shielding shell 4 to the mounting ring 3, with the front ends of the wires 20, the front shell 5 and the contact module 1 exposed outside of the shielding shell 4. Seventhly, attach the front shell 5 to the shielding shell 4 along a front-to-back direction with the wires 20 shrunk to be curly and secured in the shielding shell 4.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable connector assembly comprising:

a contact module defining a mating port and a plurality of contacts each with a front mating section and a rear connecting section;

a cable including a plurality of wires enclosed by a braiding layer which is enclosed by an outer jacket, said wire being electrically connected to the connecting sections of the corresponding contacts, respectively;

a metallic mounting ring securely enclosing the cable and directly pressing an exposed backward folded portion of the braiding layer against said outer jacket;

a metallic rear shell defining a rear tubular portion to receive the mounting ring, and a receiving cavity formed by a plurality of side walls to receive the exposed wires in front of the mounting ring and a rear portion of the contact module; and a metallic front shell enclosing a front portion of the contact module and fixed to a front portion of the rear shell; wherein the mounting ring defines exterior threads and the tubular portion of the rear shell defines interior threads engaged with the exterior threads.

2. The cable connector as claimed in claim 1, wherein the wires are exposed in front of the mounting ring with sufficient lengths for allowing easy assembling between the mounting ring and the tubular portion after the connection between the wires and the contacts, or allowing easy assembling between the wires and the contacts after connection between the mounting ring and the tubular portion.

* * * * *